US010112690B1

(12) United States Patent
Garrett

(10) Patent No.: US 10,112,690 B1
(45) Date of Patent: Oct. 30, 2018

(54) WHEEL ATTACHMENT AND TOWING SYSTEM FOR A PONTOON WATER BIKE

(71) Applicant: Patrick D. Garrett, Spicewood, TX (US)

(72) Inventor: Patrick D. Garrett, Spicewood, TX (US)

( * ) Notice: Subject to any disclaimer, the term of this patent is extended or adjusted under 35 U.S.C. 154(b) by 0 days.

(21) Appl. No.: 15/590,785

(22) Filed: May 9, 2017

(51) Int. Cl.

| | |
|---|---|
| ***B63H 19/08*** | (2006.01) |
| ***B60F 3/00*** | (2006.01) |
| ***B63C 13/00*** | (2006.01) |
| ***B63H 16/20*** | (2006.01) |
| ***B63B 1/12*** | (2006.01) |
| ***B63B 35/34*** | (2006.01) |

(52) U.S. Cl.
CPC ..... *B63C 13/00* (2013.01); *B63B 1/125* (2013.01); *B63B 35/34* (2013.01); *B63H 16/20* (2013.01); *B63H 2016/202* (2013.01); *B63H 2016/205* (2013.01)

(58) Field of Classification Search
CPC .. B63B 1/10; B63B 1/12; B63B 1/121; B63B 1/125; B63B 2001/10; B63B 2001/12; B63B 2001/121; B63B 2001/112; B63B 2001/186; B63B 2001/204; B63B 2001/205; B63B 2001/206; B63B 35/34; B63B 35/38; B63H 16/20; B63H 2016/20; B63H 2016/202; B63H 2016/205; B63C 13/00
USPC ... 440/12.5, 12.51, 12.62, 12.64, 21, 26, 27, 440/30, 32; 114/61.1, 283, 292
See application file for complete search history.

(56) References Cited

U.S. PATENT DOCUMENTS

| | | | | | |
|---|---|---|---|---|---|
| 1,034,278 | A * | 7/1912 | Munsen | B60F 3/00 | 440/12.53 |
| 2,296,147 | A * | 9/1942 | Cremer | B63H 16/14 | 440/30 |
| 2,662,236 | A * | 12/1953 | Kester | B60G 11/187 | 114/344 |
| 3,826,216 | A * | 7/1974 | Rhody | B63C 13/00 | 440/12 |
| 3,844,246 | A * | 10/1974 | Locher | B60F 3/0084 | 440/12.53 |
| 4,092,945 | A * | 6/1978 | Ankert | B62K 13/00 | 280/12.12 |
| 4,170,188 | A * | 10/1979 | Jamison, Jr. | B63B 35/73 | 440/30 |
| 4,243,239 | A | 1/1981 | Whitney | | |
| 4,285,674 | A * | 8/1981 | Chew | B63H 1/04 | 440/12 |
| 5,224,886 | A * | 7/1993 | Cunningham | B63H 16/14 | 114/283 |
| 5,387,140 | A * | 2/1995 | Cunningham | B63H 16/14 | 440/12 |
| 5,443,405 | A * | 8/1995 | Zeyger | B63H 21/175 | 440/12 |
| 5,547,406 | A | 8/1996 | White | | |
| 5,803,774 | A | 9/1998 | White | | |
| 6,095,079 | A | 8/2000 | Smidt | | |

(Continued)

*Primary Examiner* — Daniel V Venne

(57) ABSTRACT

A system of brackets and rails for attaching wheels, towing, and accessory devices to a pontoon water bike to increase the transportability and utility of the craft by making it towable by pedestrian and bicycle, converting it to amphibious operation, and allowing a variety of other attachments to create a more capable and efficient watercraft.

4 Claims, 9 Drawing Sheets

(56) References Cited

U.S. PATENT DOCUMENTS

| | | | | |
|---|---|---|---|---|
| 6,267,631 | B1 * | 7/2001 | Anderson | B63H 21/175 440/12 |
| 6,446,570 | B1 | 9/2002 | Johnson | |
| 7,096,817 | B1 | 8/2006 | Scadden | |
| 9,061,557 | B1 * | 6/2015 | Garrett | B60F 3/0084 |
| 9,522,719 | B1 * | 12/2016 | Yonover | B63H 1/36 |

* cited by examiner

WHEEL ATTACHMENT AND TOWING SYSTEM FOR A PONTOON WATER BIKE

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

This invention relates to the attachment of wheels, towing, and accessory devices to a pontoon water bike having at least one hollow transverse frame tube with exposed ends.

Pontoon water bikes are becoming increasingly more plentiful and practical as an alternative for cycling on roadways. They are used on a variety of waterways including: lakes, streams, rivers, and oceans. They are typically bulky and not easily carried by one person, especially with the addition of any gear, equipment and supplies. Therefore, they are usually conveyed to the water's edge by automobile or the combination of automobile and trailer.

Transportation of a water bike to the water by automobile is burdensome for a number of reasons, including: preparation of the vehicle and the water bike for transport, water access by the vehicle, harsh terrain, available parking, and distance to the water. First, to convey to the water by automobile, the water bike, gear, equipment and supplies must be readied, loaded into or onto a vehicle, and secured for transport. This may require additional equipment, reconfiguration of the vehicle and likely some disassembly of the water bike to make it ready for travel. Second, the desired water entry point must be accessible by the vehicle. Third, there must be parking at the water's edge at the exact point of entry, otherwise the water bike, gear, equipment and supplies will have to be unloaded at the water's edge and the vehicle moved to a suitable parking location. In such a case, the driver would have to leave the water bike and gear unattended by the water's edge while parking the vehicle, then walk back to the water bike from the vehicle after it is parked.

Similarly, conveying a water bike by combination of automobile and trailer is even more burdensome and likely more expensive than loading onto an automobile, as it requires additional cost, time and effort to acquire the trailer, store it, maintain it, and retrieve it for the same purpose and with the same burdens listed above for transporting by automobile.

Conventional transportation by an automobile, with or without a trailer, is especially impractical when the distance to the water is very short. The nature of water bikes, and small watercraft in general, implies not only an economy of size and price, but also an economy of time and effort required to enjoy them. To a water bike user, it would seem reasonable to expect the amount of time and effort required to get the water bike to the water to be proportional to the size of the watercraft and the distance to the water. Practicality suggests that if the trip to the water is shorter by walking or riding a bicycle than the time it would take to load the craft, transport it by automobile, and then unload it at the water's edge, then a pedestrian or bicycle towing solution should be available, thus allowing quicker and easier access to the water without the use of a vehicle and all of the associated additional time and effort required.

The notion of the economy of scale of time and effort relative to the distance from the water is particularly relevant when a water bike owner lives, vacations or camps near the water. For example, many water bike owners live in communities near the water and merely desire to transport their craft a very short distance across their property, down the street, or through the neighborhood. When readying a water bike for a trip of one hundred feet by automobile could take the same amount of preparation as a trip of one hundred miles, the effort is disproportionately inconvenient and troublesome. And even when the water bike is at or near the water's edge, a solution for launching and towing over very short distances is just as important as long distances when the rider is unable to carry the craft alone and it is undesirable to drag the craft over land, especially when the terrain is treacherous.

Prior art reveals a very limited number and variety of solutions applicable to attaching wheels and towing devices to pontoon water bikes for pulling over land by pedestrian and bicycle.

U.S. Pat. No. 4,243,239, issued to Whitney (1981), reveals a dolly for a catamaran held in place under the catamaran hulls by a flexible line attached to the watercraft for hand towing by pedestrian. This system does not appear to offer a sturdy and reliable connection, especially when changing direction, nor does it have a solution for connecting to a bicycle.

U.S. Pat. No. 5,803,774, issued to White (1998), displays a trailerable amphibious bicycle with retractable wheels that is powered and trailered by the same bicycle. The craft is an integrated system with wheels already included and built specifically for that particular watercraft (and its related patent for an amphibious water craft, U.S. Pat. No. 5,547,406, as referenced and by the same owner), and therefore does not appear to be readily removable, transferable and easily attachable to other pontoon water bikes having transverse frame tubes with exposed ends.

U.S. Pat. No. 6,095,079, issued to Smidt (2000), discloses a folding pontoon boat with removable wheels attached to the pontoons for portage by hand. The wheels are specifically designed for and secured to those specific pontoons and do not appear to be readily transferable and attachable to other pontoon water bikes having transverse frame tubes with exposed ends.

U.S. Pat. No. 6,446,570 B1, issued to Johnson (2002), describes an attachable portage apparatus for a lightweight pontoon watercraft having a central frame, where a single removable wheel is attached to a central strut mounted to the central frame of the watercraft and is maneuvered over land by hand in wheelbarrow fashion. Johnson teaches away from attaching multiple wheels citing the single wheel design as an advantage to movement over uneven ground. Similarly, U.S. Pat. No. 7,096,817 B1, issued to Scadden (2006), exhibits a pontoon float boat with a single removable wheel fixed to a receiver on the platform structure between the floats for movement of the craft over land, also in a wheelbarrow fashion. While Johnson and Scadden have similar removably attached single wheel assemblies, Johnson uses a removably attached central strut mounted to the boat frame, while Scadden permanently mounts a single receiver to the boat platform structure intermediate between the floats. Neither would offer the balance of a multiwheel system, nor do they appear to be readily transferable and attachable to other pontoon water bikes having transverse frame tubes with exposed ends.

In conclusion, in so far as I am aware, no apparatus or system formerly developed allows for the attachment of multiple wheels and other devices, simultaneously, in various locations and configurations to a pontoon water bike having transverse frame members with exposed ends for towing by pedestrian and bicycle.

Advantages

Accordingly, several advantages of one or more aspects are as follows: a system of brackets and rails for attaching wheels, towing devices, and other accessories in a variety of locations and combinations to a pontoon water bike having one or more transverse frame tubes with exposed ends, for the purpose of towing over land by a single person, by hand, bicycle or other suitable small vehicle. Among the advantages are the ability to add devices to an existing pontoon water bike frame without the need for tools, drilling holes or modifying the structure. The pontoon water bike frame inherently provides the fundamental components of a trailer and mounting structure, so no separate trailer is needed. The combination of brackets and rails provide an easy, economical and reliable non-twisting connection even to round transverse frame tubes.

Multiple wheels can be added quickly and easily in a variety of configurations to create a very stable multi-wheel towing solution that will not tip easily and does not require the effort to balance and steer as single wheel designs. In at least one embodiment wheels may be adjustably positioned fore and aft for desirable weight distribution over the wheels, and the wheel posts can be selectively positioned inside of the cross tube receiver brackets to change the height of the wheels relative to the water bike.

Wheels and towing capabilities provides faster access to the water than driving when the distance to the water is relatively short and when walking or biking is faster than taking the time to load the water bike into or onto an automobile or trailer for transport to the water. The water bike also becomes more environmentally friendly without the need for an automobile, and can more easily reach the water for launching and retrieval of the craft directly at the water's edge.

A variety of accessories can also be easily mounted to the brackets and rails, such as a bike rack for taking the bicycle with the water bike across the water to become a truly amphibious transportation system, allowing the craft to become more useful, fun, and versatile to use.

Manufacturing of the brackets and rails is possible to fit any size or shape of tube or length of rail as needed to fit a variety of pontoon water bike frames.

Other advantages of one or more aspects will become apparent from a consideration of the drawings and ensuing description.

SUMMARY

In accordance with one embodiment, a system of brackets and rails for attaching wheels, towing, and accessory devices to a pontoon water bike to increase the transportability and utility of the craft by making it towable by pedestrian and bicycle, converting it to amphibious operation, and allowing a variety of other attachments and attachment means to create a more capable and efficient water and amphibious craft.

REFERENCE NUMERALS

| | | | |
|---|---|---|---|
| 31 | Pontoon Water Bike | 32 | Rudder Tube |
| 33 | Pontoon | 34 | Carrying Strap |
| 35 | Rudder | 36 | Drive Unit |
| 37 | Propeller | 38 | Transverse Frame Tube |
| 39 | Hand Knob | 40 | Deck |
| 41 | Cross Tube Receiver Bracket | 42 | Hole |
| 43 | Wheel Assembly | 44 | Wheel Post |
| 45 | Wheel | 46 | Bolt |
| 47 | Nut | 48 | Pin |
| 49 | Pedestrian | 50 | Sliding Receiver Bracket |
| 51 | Side Rail | 52 | Frame Yoke |
| 53 | Yoke Bar | 54 | U-Bracket |
| 55 | Tow Bar Receiver Tube | 56 | Seatpost Hitch |
| 57 | Tow Bar Washer | 58 | Tow Bar Stopper Collar |
| 59 | Frame Tow Bar | 60 | Bicycle |
| 61 | Seat Tube | 62 | Seatpost |
| 63 | Bicycle Seat | 64 | Pontoon Receiver Bracket |
| 65 | Screw | 66 | Cross Rail |
| 67 | Pontoon Tow Bar | 68 | Wheel Cradle |
| 69 | Wheel Strap | 70 | Bicycle Wheel |

DETAILED DESCRIPTION

One embodiment of a wheel attachment and towing system for a pontoon water bike is illustrated as follows.

Figure 1:
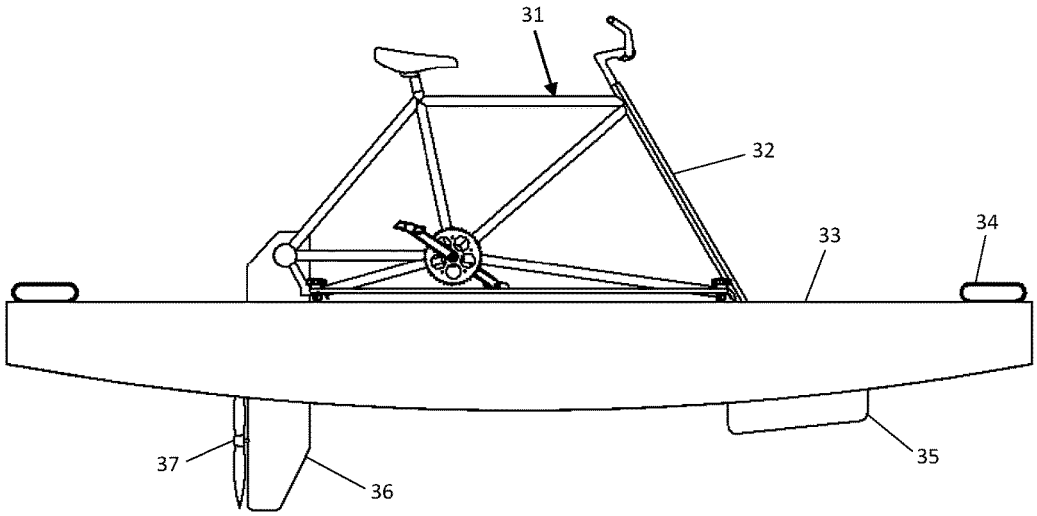
FIG. 1 is a right side view of a pontoon water bike.

FIG. 1 illustrates a right side view of a pontoon water bike 31, having a rudder tube 32, two spaced apart pontoons 33 with carrying straps 34, rudder 35, drive unit 36 with propeller 37.

Figure 2:
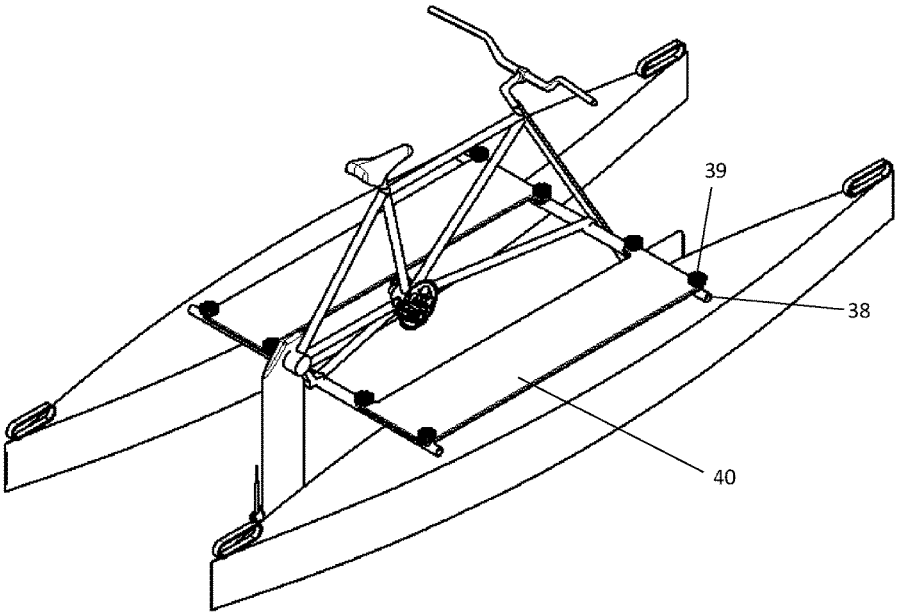
FIG. 2 is a right rear perspective view of a water bike.

FIG. 2 illustrates a right rear perspective view showing transverse frame tube 38, hand knob 39 and deck 40.

Figure 3:
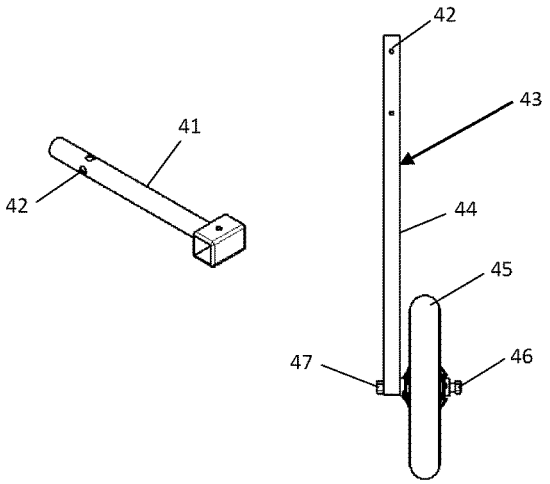
FIG. 3 is perspective view of a cross tube receiver bracket and an end view of a wheel assembly.

FIG. 3 illustrates a perspective view of a cross tube receiver bracket 41 with holes 42, and an end view of a wheel assembly 43, with holes 42, wheel post 44, wheel 45, bolt 46, and nut 47.

Figure 4:
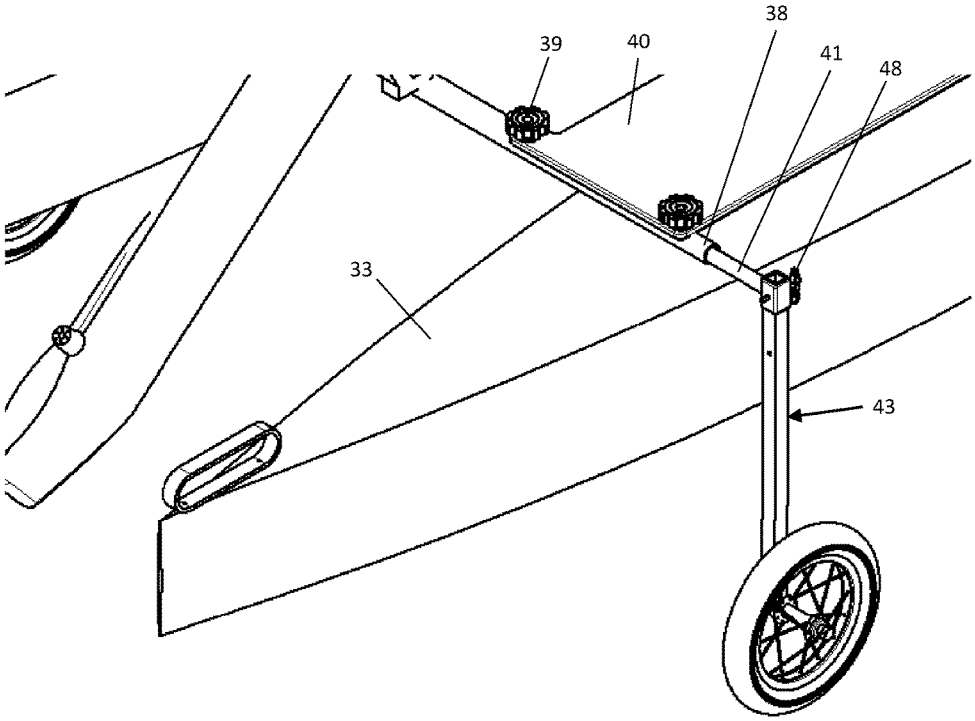
FIG. 4 is a right rear perspective view of a wheel assembly attached to a pontoon water bike.

FIG. 4 illustrates a right rear perspective view of hand knob 39, deck 40, cross tube receiver bracket 41, pin 48 with wheel assembly 43 and pontoon 33.

Figure 5:
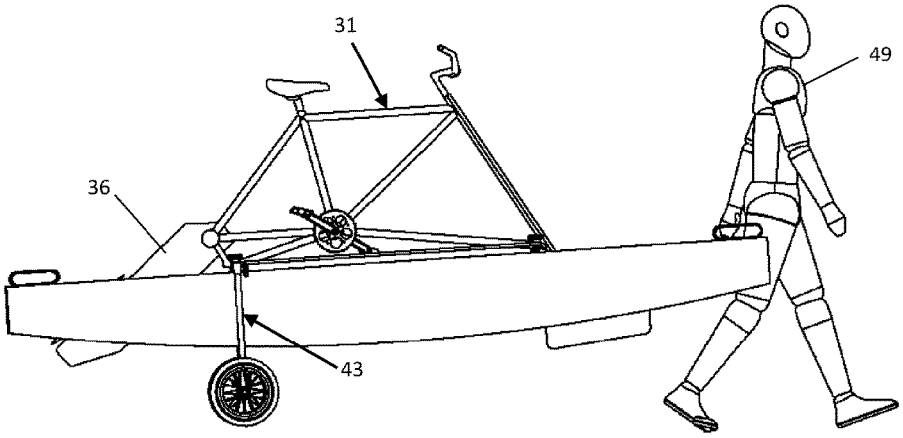
FIG. 5 is a right side view of a water bike with wheels attached and being towed by a pedestrian.

FIG. 5 illustrates a right side view of a water bike 31, wheel assemblies 43 attached, drive unit 36 in an upright position for towing over land by a pedestrian 49.

Figure 6:
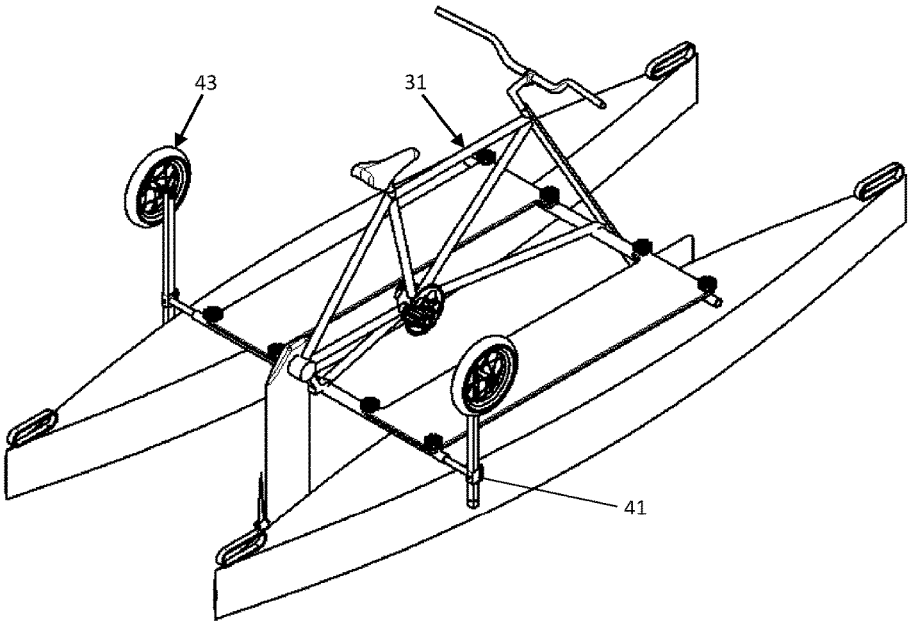
FIG. 6 is a right rear perspective view of a water bike with wheels attached and oriented in an upright position for water operation.

FIG. 6 illustrates a right rear perspective view of a water bike 31, with wheel assemblies 43 attached to cross tube receiver brackets 41 and oriented in an upright position for water operation.

Figure 7:
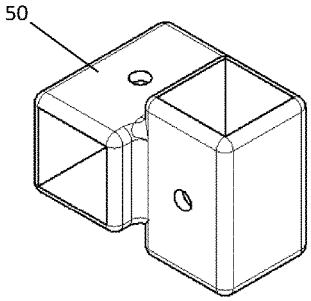
FIG. 7 is a perspective view of a sliding receiver bracket.

FIG. 7 illustrates a perspective view of a sliding receiver bracket 50.

Figure 8:
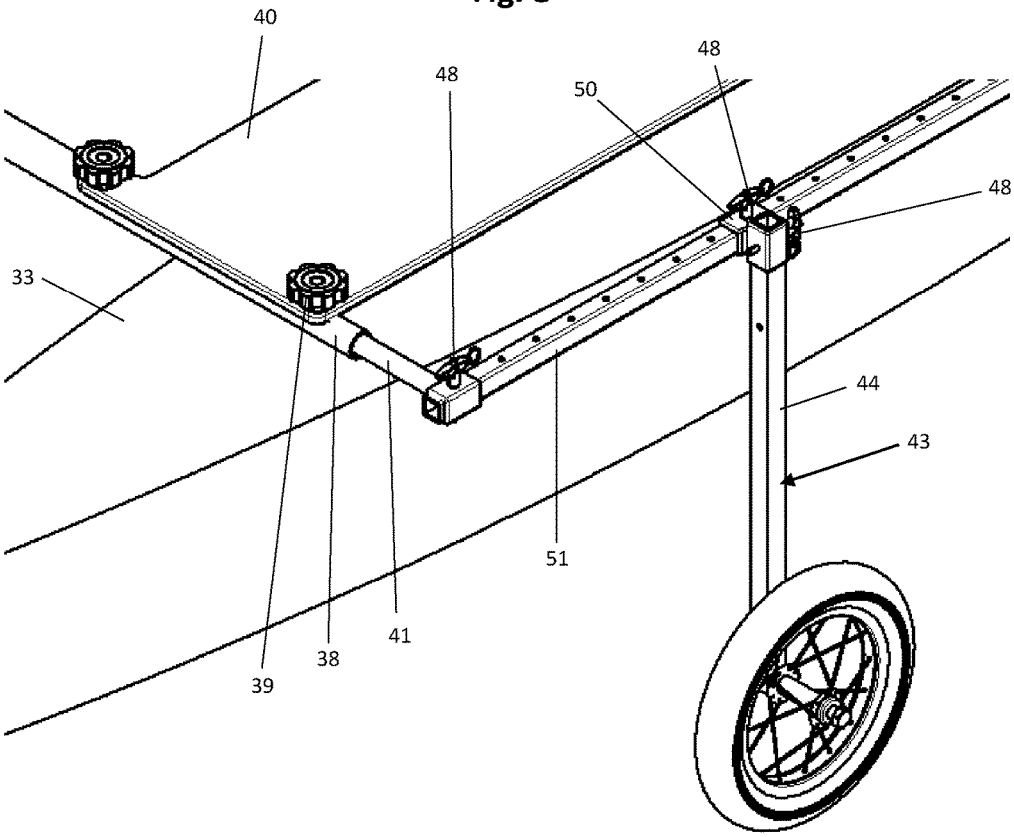
FIG. 8 is a right rear perspective view of a wheel assembly attached to a water bike with a side rail.

FIG. 8 illustrates a right rear perspective view of wheel post 44 of wheel assembly 43 removably attached to sliding receiver bracket 50 and adjustably positioned on side rail 51, which connects thru cross tube receiver bracket 41, coupled with pins 48, and secured to transverse frame tube 38, pontoon 33 and deck 40 with hand knob 39.

Figure 9:
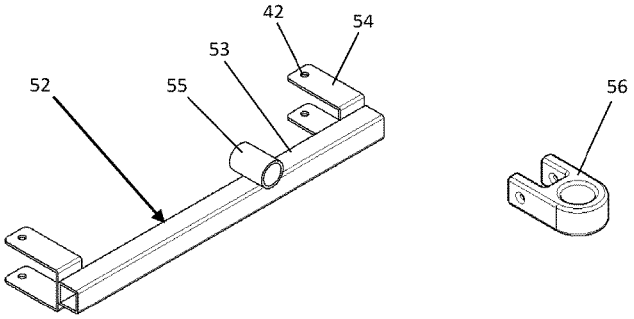
FIG. 9 is a perspective view of a frame yoke and a seatpost hitch.

FIG. 9 illustrates a perspective view of a frame yoke 52, having yoke bar 53 with u-brackets 54 on each end and holes 42 for mounting, with a tow bar receiver tube 55 positioned off-center, and a separate seatpost hitch 56.

Figure 10:
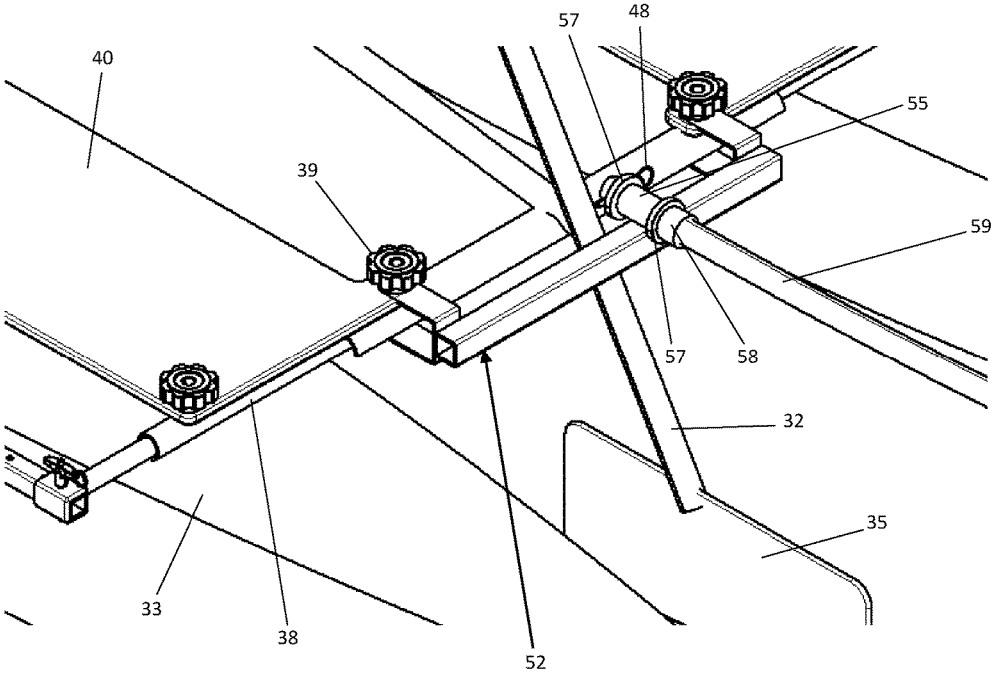
FIG. 10 is a right front perspective view of a frame yoke mounted to a transverse frame tube of a water bike.

FIG. 10 illustrates a right front perspective view of a frame yoke 52 mounted to a transverse frame tube 38 with hand knobs 39 securing to deck 40 and pontoon 33. Tow bar receiver tube 55 is offset from the center of frame yoke 52 sufficiently to clear rudder tube 32 for operation of rudder 35. Frame yoke 52 connects to frame tow bar 59 having tow bar stopper collar 58 with tow bar washers 57 and pin 48.

Figure 11:
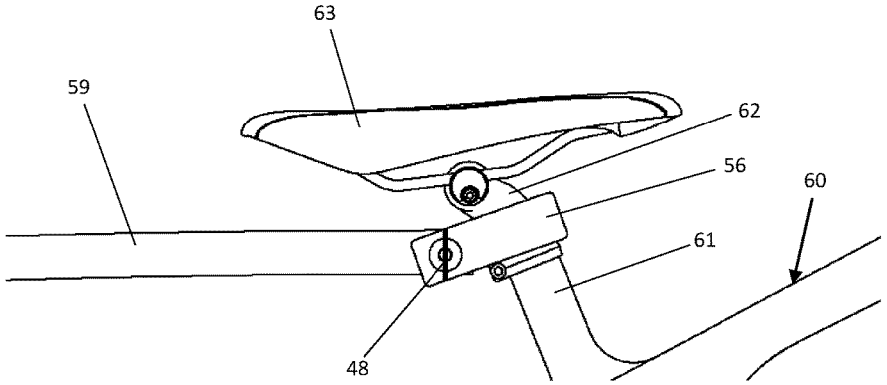
FIG. 11 is a right side view of a bicycle with seatpost hitch in towing configuration.

FIG. 11 illustrates a right side view of bicycle 60 having seat tube 61, seatpost 62, and bicycle seat 63, with seatpost hitch 56, frame tow bar 59 and pin 48.

Figure 12:
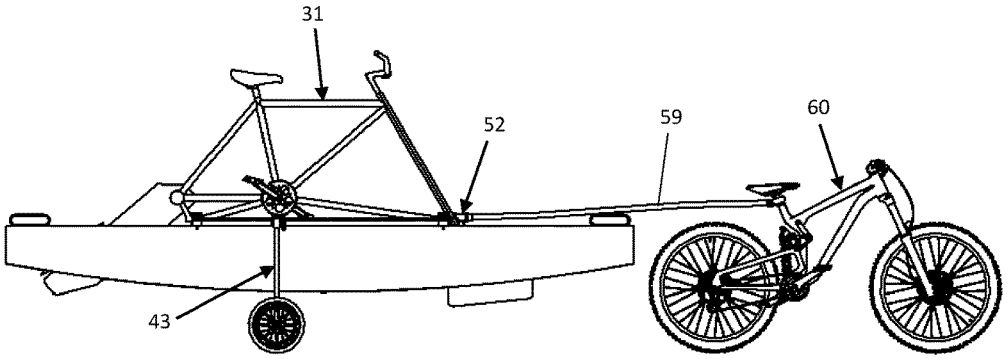
FIG. 12 is a right side view of a bicycle towing a pontoon water bike using a frame yoke connection.

FIG. 12 illustrates a right side view of a bicycle 60, frame tow bar 59, frame yoke 52, pontoon water bike 31 and wheel assemblies 43.

Figure 13:
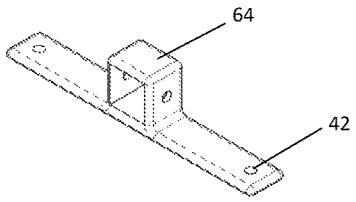
FIG. 13 is a perspective view of a pontoon receiver bracket.

FIG. 13 illustrates a perspective view of a pontoon receiver bracket 64 with holes 42.

Figure 14:
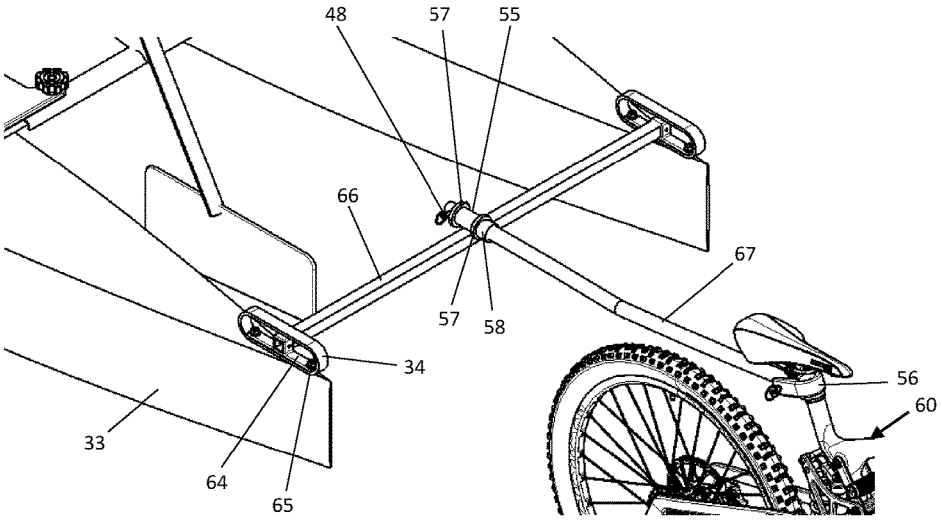
FIG. 14 is a right front perspective view of a bicycle towing a pontoon water bike using a pontoon receiver bracket and cross rail configuration.

FIG. 14 illustrates a right front perspective view of cross rail 66 connected on both ends to pontoon receiver brackets 64 attached to pontoons 33 with screws 65 inside of carrying straps 34. Cross rail 66 has tow bar receiver bracket 55 for connection to pontoon tow bar 67 with tow bar washers 57, pin 48 and tow bar stopper collar 58. Pontoon tow bar 67 is coupled to bicycle 60 with seatpost hitch 56.

Figure 15:
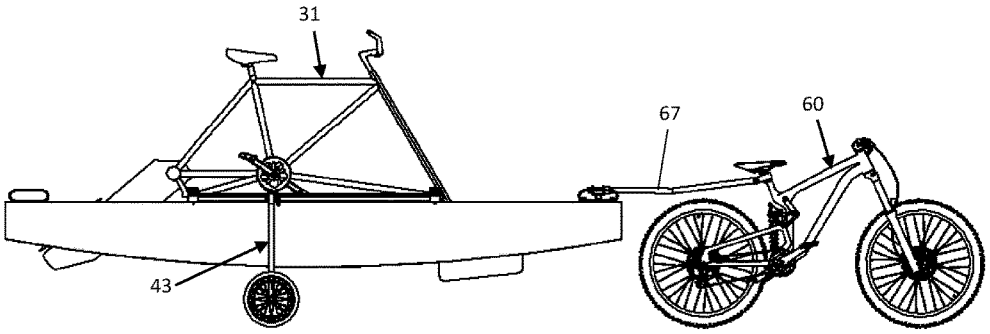
FIG. 15 is a right side view of a bicycle towing a pontoon water bike using a pontoon receiver bracket configuration.

FIG. 15 illustrates a right side view of a bicycle 60 with a pontoon tow bar 67 towing a pontoon water bike 31 with wheel assemblies 43.

Figure 16:
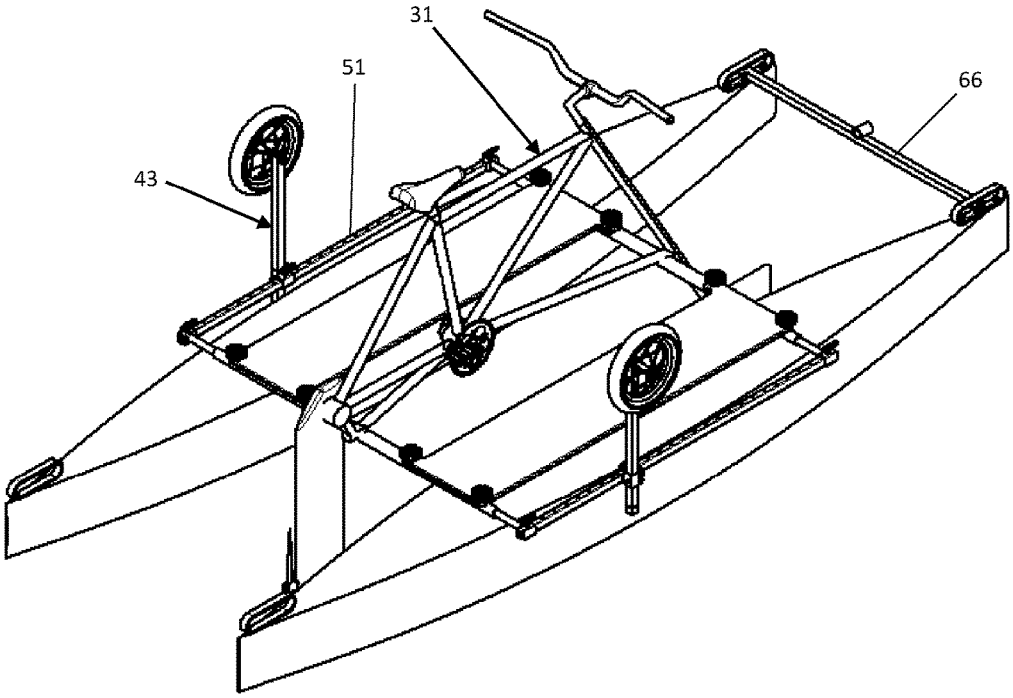
FIG. 16 is a right rear perspective view of a pontoon water bike with wheels attached to a bracket and rail mounting system in water operation mode.

FIG. 16 illustrates a right rear perspective view of a pontoon water bike 31 with wheel assemblies 43 coupled to side rails 51 in water operation mode with cross rail 66 attached for bicycle towing.

Figure 17:
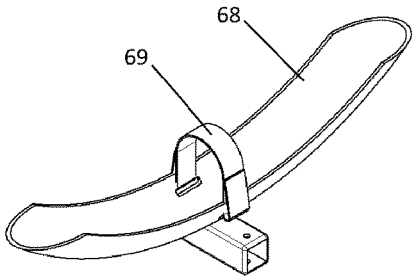
FIG. 17 is a perspective view of a wheel cradle.

FIG. 17 illustrates a perspective view of a wheel cradle 68 with wheel strap 69.

Figure 18:
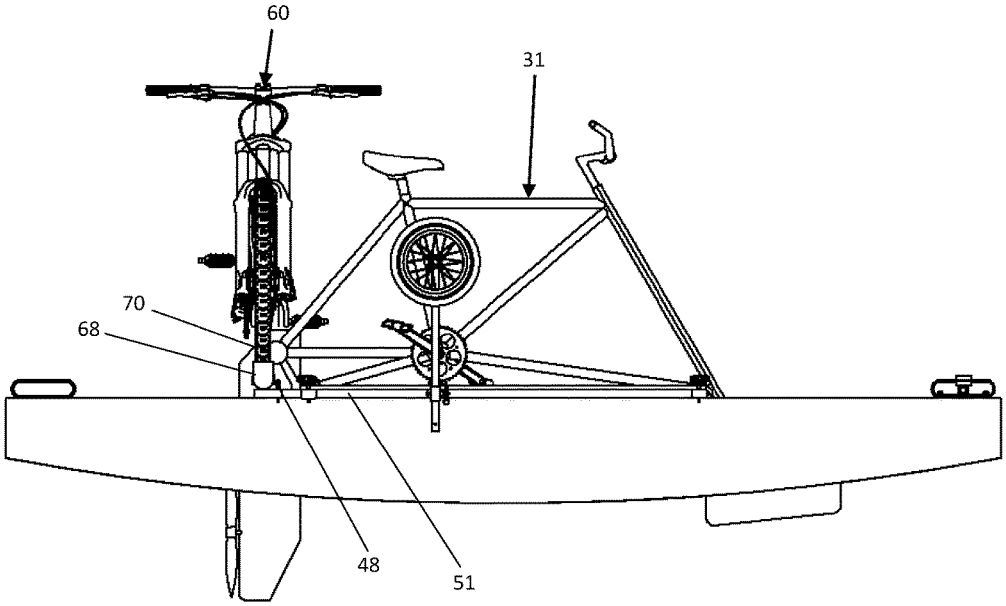
FIG. 18 is a right side view of a pontoon water bike with bracket and rail system in water operation mode carrying a bicycle attached to a wheel cradle.

FIG. 18 illustrates a right side view of a pontoon water bike 31 in water operation mode with bicycle 60 having bicycle wheel 70 coupled to wheel cradle 68, held in place to side rail 51 with pin 48.

Operation—One Embodiment of Attachment of Wheels to Transverse Frame Tube—FIGS. 3, 4, 5 & 6

To attach wheels to a pontoon water bike having at least one transverse frame tube spanning spaced apart pontoons: remove the existing hand knobs 39 from the outermost ends of a transverse frame tube 38, slide a cross tube receiver bracket 41 into each open end of transverse frame tube 38 with holes 42 in sufficient alignment with the existing holes in the transverse frame tube 38 with the receiver opening of cross tube receiver bracket 41 facing vertically, then replace hand knob 39 in its original position now securing cross tube receiver bracket 41 inside of transverse frame tube 38 ready to receive wheel post 44 in a vertically oriented position. Insert wheel posts 44 of wheel assemblies 43 inside each of the cross tube receiver brackets 41 and pin each in place with pins 48. A pontoon water bike 31 can now be pulled easily over land by a pedestrian 49.

Operation—One Embodiment of Reorienting Wheel Posts Inside Cross Tube Receiver Brackets—FIGS. 3, 4, 5 & 6

Wheel post 44 may be easily reoriented as desired inside cross tube receiver bracket 41 simply by removing pin 48 and either orienting wheel 45 down for towing over land, or up for water operation, and fix in place with pin 48. The height of wheels 45, relative to the water or the ground, may also be adjusted by selectively sliding wheel post 44 inside cross tube receiver bracket 41 and fixing in place with pin 48.

Operation—One Embodiment of Attachment of Bracket & Rail System—FIGS. 7 & 8

To attach a bracket and rail system to a pontoon water bike having multiple transverse frame tubes: remove the existing hand knobs 39 from the outermost ends of two transverse frame tubes 38, slide a cross tube receiver bracket 41 into each open end of transverse frame tubes 38 with holes 42 in sufficient alignment with the existing holes in the transverse frame tubes 38 with the receiver opening of cross tube receiver brackets 41 facing horizontally, then replace hand knobs 39 in their original position now securing cross tube receiver brackets 41 inside of transverse frame tubes 38 with both of the openings of the cross tube receiver brackets oriented horizontally and in sufficient alignment with each other. Next, slide one end of side rail 51 through either cross tube receiver bracket 41, then slide a sliding receiver bracket 50 onto side rail 51, and continue to insert the side rail 51 into the second cross tube receiver bracket and pin in place at both ends with pins 48.

The bracket and rail system allows wheels to be mounted and selectively positioned fore and aft to distribute weight over the wheels as desired for towing, launching and recovery, and to allow the attachment of other mounting devices and accessories.

Operation—One Embodiment of Selective Positioning of Sliding Receiver Brackets on Side Rails—FIGS. 7 & 8

To selectively position sliding receiver brackets 50 fore and aft on side rails 51 for desired weight distribution over wheels 45, simply remove pins 48 from each sliding receiver bracket 50 coupled to side rail 51 on each side of the watercraft and slide fore or aft along side rail 51 to a desired position and fix in place with pins 48.

Operation—Reorienting Wheel Posts Inside Sliding Receiver Brackets—FIGS. 7 & 8

Wheel post 44 may be easily reoriented as desired inside the sliding receiver bracket 50 simply by removing pin 48 and orienting wheel 45, either down for towing over land or up for water operation, and fix in place with pin 48. The height of wheels 45, relative to the water or the ground, may be adjusted by selectively sliding wheel post 44 inside of sliding receiver bracket 50 and fixing in place with pin 48.

Operation—One Embodiment of Mounting Frame Yoke to Transverse Frame Tube—FIGS. 9 & 10

To mount frame yoke 52 to transverse frame tube 38, remove the two front inbound hand knobs 39, slide u-brackets 54 over transverse frame tubes 38 until holes 42 are in sufficient alignment and fix in place on both ends by reinstalling hand knobs 39 in their original positions, now securing frame yoke 52, decks 40, transverse frame tube 38, and pontoons 33 together. Note that tow bar receiver tube 55 is offset from center of yoke bar 53 so as to not interfere with rudder tube 32.

Operation—One Embodiment of Bicycle or Other Vehicle Towing by Frame Yoke—FIGS. 10, 11 & 12

To attach a bicycle to frame yoke 52 for bicycle towing, slide one tow bar washer 57 onto frame tow bar 59 until it stops against tow bar stopper collar 58, insert frame tow bar 59 thru tow bar receiver tube 55 until it stops by contact when tow bar receiver tube 55, tow bar washer 57, and tow bar stopper collar 58 meet. Slide a second tow bar washer 57 onto the end of frame tow bar 59 and install pin 48 in the end of frame tow bar 59 to rotationally couple frame tow bar 59 and frame yoke 52 together, allowing frame tow bar 59 to rotate within tow bar receiver tube 55. Remove seatpost 62 from seat tube 61 of bicycle 60 and slide seatpost hitch 56 over seatpost 62 and reinstall seatpost 62 into seat tube 61. Attach the available end of frame tow bar 59, opposite the end already attached to frame yoke 52 previously, and couple frame tow bar 59 to seatpost hitch 56 with pin 48 under bicycle seat 63.

A standard bicycle, or other vehicle, can now be attached to the transverse frame tube of a pontoon water bike for towing over land.

Operation—One Embodiment of Mounting Cross Rail and Pontoon Receiver Brackets to Pontoons—FIGS. 13 & 14

An alternative attachment point for bicycle towing, rather than attaching a frame yoke to a transverse frame tube of a pontoon water bike, is to make a connection to the pontoons by: removing carrying straps 34 from one end of both pontoons 33 and installing pontoon receiver brackets 64, one on each pontoon 33, and reinstalling the carrying straps 34 over the pontoon receiver brackets, or leaving them off if desired, by reinstalling screws 65 thru holes 42 in pontoon receiver brackets 64, and carrying straps 34 if reinstalling, to provide a connection point for cross rail 66. Next insert the ends of cross rail 66 through the receivers in pontoon receiver brackets 64 and fix in place with pins 48, holding securely to pontoons 33. Cross rail 66 has a tow bar receiver bracket 55 providing a secure connection point for towing by bicycle or other vehicle.

Operation—One Embodiment of Bicycle or Vehicle Towing by Pontoon Towing Connection—FIGS. 11, 14, 15 & 16

To attach a bicycle to a pontoon water bike by connection to the pontoons, slide one tow bar washer 57 onto pontoon tow bar 67 until it stops against tow bar stopper collar 58, insert pontoon tow bar 67 thru tow bar receiver tube 55 of cross rail 66 until it stops by contact when tow bar receiver tube 55, tow bar washer 57, and tow bar stopper collar 58 meet. Slide a second tow bar washer 57 onto the end of pontoon tow bar 67 and install pin 48 in the end of pontoon tow bar 67 to rotationally couple pontoon tow bar 67 and cross rail 66 together, allowing pontoon tow bar 67 to rotate within tow bar receiver tube 55. Remove seatpost 62 from seat tube 61 of bicycle 60 and slide seatpost hitch 56 over seatpost 62 and reinstall seatpost 62 into seat tube 61. Attach the available end of pontoon tow bar 67, opposite the end already attached to cross rail 66, previously, and couple pontoon tow bar 67 to seatpost hitch 56 with pin 48 under bicycle seat 63.

A standard bicycle, or other vehicle, can now be attached to the pontoons of a pontoon water bike for towing over land.

Operation—One Embodiment of Attaching a Bike Carrier to Make Amphibious—FIGS. 16, 17 & 18

To make a pontoon water bike amphibious: attach a wheel cradle 18 to side rail 51 with pin 48 in a suitable location to fix a bicycle wheel 70 of bicycle 60 to a pontoon water bike 31 with wheel strap 69, leaving cross rail 66 installed for towing (as an example of one embodiment) and orient wheel assemblies 43 in water mode position. A bicycle wheel cradle 68 can be used on both bicycle wheels, or just one. In the case of using just one bicycle wheel cradle 68, the remaining bicycle wheel can be secured with straps to the other pontoon frame of the pontoon water bike.

Operation—Attaching Other Accessories—FIGS. 3-18

In addition to the brackets, rails and towing devices already described, other accessories can be attached in various combinations, locations and embodiments to one or a multiple of: a cross tube receiver bracket 41, side rail 51, sliding receiver bracket 50, frame yoke 52, pontoon receiver bracket 64, and/or cross rail 66, for purposes of steering, storage, mooring, holding equipment, or to make other connection points, just to name a few.

Alternative embodiments may be easily achieved by adapting the previously listed brackets and rails to be welded directly to pontoon water bike frame members, and/or used in combination with welding, bolting, pinning, tensioning connectors, or slip-on connections, as well as using various shapes and sizes of tubes, brackets and associated receiver openings.

CONCLUSION, RAMIFICATIONS AND SCOPE

Thus the reader will see that at least one embodiment of the system of brackets and rails for attaching wheels, towing, and accessory devices will increase the transportability and utility of a pontoon water bike by making it towable by pedestrian and bicycle, converting it to amphibious operation, and allowing a variety of other attachments and attachment means to create a more capable and efficient craft.

While the above description contains many specifics, these should not be construed as limitations on the scope, but rather as an exemplification of one or more embodiments thereof. Many other variations of size, material, shape, and configurations are possible. For example, a variety of suitable structural materials could be employed, such as steel, aluminum, plastic, wood, composites, carbon fiber, or some combination thereof; parts could be produced as one component, such as a cast or injection molded part, or could be formed by multiple methods and materials combined together by welding, gluing, bolting, or some other form of bonding. Brackets can be made to slip-on or be welded on, and can be produced to fit virtually any size and shape of tube. Brackets and attachments can be removably fixed in place in a variety of methods, including: pins, spring clips, bolts, compression fittings, or other clamping devices; the locations and orientations of brackets and accessories are also variable. Wheel posts could be straight, "L-Shaped", curved, or formed into any design of any shape of material. Rails can be added in a multitude of locations and configurations including cross rails fore and/or aft of the watercraft and connected to side rails in various combinations. And connection points on the bicycle for towing may be adapted to many locations, including at the bicycle seatpost, seat, rear bicycle rack, rear axle, or other common locations where commercially available standard bicycle hitches and connections are made.

Thus the scope of the embodiments should be determined by the appended claims and their legal equivalents, rather than by the examples given.

I claim:

1. A system for attaching wheels to a pontoon water bike, comprising in combination:

said pontoon water bike having a plurality of transverse frame tubes with exposed ends spanning a plurality of spaced apart pontoons, a plurality of cross tube receiver brackets coupled to the ends of a plurality of the transverse frame tubes, whereby a plurality of the cross tube receiver brackets are aligned longitudinally along each side of the pontoon water bike, a plurality of side rails coupled to the cross tube receiver brackets aligned along each side of said pontoon water bike, a plurality of sliding receiver brackets, with each sliding receiver bracket coupled to said side rail, a plurality of wheel assemblies, with each wheel assembly coupled to each sliding receiver bracket, whereby the water bike is able to be wheeled over land.

2. The system of claim 1, further comprising:

a frame yoke coupled to said transverse frame tube, a frame tow bar coupled to said frame yoke, a bicycle coupled to said frame tow bar, whereby the bicycle is able to tow the pontoon water bike over land.

3. The system of claim 1, further comprising:

a pair of pontoon receiver brackets coupled to said pontoons, a cross rail coupled to said pontoon receiver brackets, a pontoon tow bar coupled to said cross rail, a bicycle coupled to said pontoon tow bar, whereby the bicycle is able to tow the pontoon water bike over land.

4. The system of claim 1, further comprising:

at least one wheel cradle coupled to said side rail, a bicycle coupled to said wheel cradle, whereby the pontoon water bike is able to carry the bicycle over water to achieve amphibious operation.

* * * * *